US006638549B1

(12) United States Patent
Lloyd

(10) Patent No.: US 6,638,549 B1
(45) Date of Patent: Oct. 28, 2003

(54) SYSTEM FOR STORAGE AND DELIVERY OF POWDERED NUTRITIONAL SUPPLEMENTS

(76) Inventor: Christopher A. Lloyd, 3850 County Farm Rd., Eugene, OR (US) 97408

( * ) Notice: Subject to any disclaimer, the term of this patent is extended or adjusted under 35 U.S.C. 154(b) by 0 days.

(21) Appl. No.: 09/500,068

(22) Filed: Feb. 8, 2000

Related U.S. Application Data

(60) Provisional application No. 60/130,854, filed on Apr. 22, 1999.

(51) Int. Cl.[7] ..... A47G 21/18

(52) U.S. Cl. ..... 426/115; 426/2; 426/85; 426/394; 604/58

(58) Field of Search ..... 604/57, 58, 77; 426/2, 85, 115, 394

(56) References Cited

U.S. PATENT DOCUMENTS 1,254,115 A * 1/1918 Brand ..... 426/115
2,160,367 A * 5/1939 Maxfield ..... 53/433
2,867,536 A * 1/1959 Mead et al. ..... 426/85
2,901,357 A * 8/1959 Epstein ..... 426/85
3,473,650 A * 10/1969 Hoag ..... 426/115
4,387,809 A * 6/1983 Botzler ..... 426/115
5,223,264 A 6/1993 Wehling et al.
5,904,924 A * 5/1999 Gaynor et al. ..... 424/195.17
6,358,544 B1 * 3/2002 Henry et al. ..... 426/590

* cited by examiner

*Primary Examiner*—J. Casimer Jacyna

(57) ABSTRACT

An apparatus for storing and delivering a powdered nutritional supplement comprises: a) an elongated tube; and b) a volume of powdered nutritional supplement contained within the tube. The ends of the tube may be sealed to retain the powdered supplement within the tube, and at least one end may be opened to deliver the powdered supplement from the tube. A method for storing a powdered nutritional supplement comprises the steps of: a) filling an elongated tube with the powdered supplement; and b) sealing the ends of the tube, thereby retaining the powdered supplement within the tube for storage. A method for delivering a powdered nutritional supplement comprises the steps of a) providing a container filled with a volume of the powdered supplement corresponding to a single dose; b) opening the container; and c) allowing the powdered supplement to leave the container for delivery directly into the mouth. The container and/or tube may comprise a straw (similar to a drinking straw) and may be sealed by crimping the ends. The tube may contain a single dose of the powdered supplement to be delivered directly into the mouth.

10 Claims, 3 Drawing Sheets

SYSTEM FOR STORAGE AND DELIVERY OF POWDERED NUTRITIONAL SUPPLEMENTS

RELATED APPLICATIONS

This application claims benefit of prior-filed co-pending provisional application Ser. No. 60/130,854, filed Apr. 22, 1999, said application being hereby incorporated by reference as if fully set forth herein.

FIELD OF THE INVENTION

The field of the present invention relates to nutritional supplements. In particular, apparatus and methods are described herein for storing and delivering single doses of a nutritional supplement in powdered form.

BACKGROUND

Currently, over-the-counter nutritional supplements (vitamins, multi-vitamins, minerals, amino acids, herbals, combinations thereof, and the like for adults and/or children) are typically available in two delivery forms: capsules/caplets/tablets designed to be swallowed whole or chewable tablets. However, each of these forms has distinct disadvantages which render consistent and regular delivery and consumption of the supplements problematic.

Chewable supplements (often intended for children, but also used by adults) are typically dyed, shaped, and/or flavored to render them attractive and/or palatable. They are often almost candy-like. However, these desirable features come at the expense of concomitant undesirable characteristics. In order to maintain structural integrity prior to consumption, chewable supplements are compressed into dense forms that require vigorous chewing to break apart. The vigorous chewing required may be precluded by the presence of dental problems, dental work, dental hardware, orthodontics, and the like. After chewing, a significant portion of the supplement may end up stuck in the teeth, thereby reducing and rendering uncertain the dosage actually delivered. The bright coloring of the supplement may leave the mouth and teeth discolored, and the taste may linger for a long period of time. From a practical standpoint, such supplements are often taken by adults or children or given to children as part of an already complex and frantic morning routine. The characteristics of the supplement alluded to above makes the relative ordering of delivering the supplement and brushing one's teeth quite important (generally, delivery and consumption of the supplement should precede brushing the teeth). If this ordering is not followed, one may spend the rest of the day with discolored mouth and teeth, the teeth must be re-brushed, or a harried parent may elect to skip a child's supplement for that day.

The physical nature of a chewable supplement may also render it susceptible to deterioration or loss of freshness; therefore such a supplement is often stored in a container that may be re-sealed after opening. However, a child may not be careful to re-seal the container after each use, and the remaining supplement may be ruined and therefore wasted. Storage of a limited supply of supplement independent of the container (for a short trip or excursion, for example) is also complicated by degradation of the supplement outside of the container.

Powdered supplements suitable for dissolving in water are available, resulting in a drink to be consumed for administering the supplement. While such supplements alleviate some problems described herein, they are susceptible to staleness, loss of freshness, and/or deterioration, and are not particularly convenient or easy to use, especially for young children. Obviously, water and a drinking vessel are required for their use, and may not be readily available. Storage, transportation, and/or delivery of a limited number of doses are not readily facilitated by such powdered supplements.

Capsules, caplets, and/or tablets designed to be swallowed whole may present a different set of difficulties. Most young children (and many adults, in fact) have not developed a knack for swallowing tablets whole. In such a form, there are typically no taste and/or shape incentives to entice children or adults into taking the supplement.

It is therefore desirable to provide a system for storage and delivery of nutritional supplements which may overcome one or more of these drawbacks of previous methods of storing and delivering such supplements.

SUMMARY

Certain aspects of the present invention may overcome one or more aforementioned drawbacks of the previous art and/or advance the state-of-the-art of systems for storage and delivery of powdered nutritional supplements, and in addition may meet one or more of the following objects:

- To provide a system for storage and delivery of powdered nutritional supplements wherein single doses of powdered supplement may be stored and/or delivered;
- To provide a system for storage and delivery of powdered nutritional supplements wherein the powdered supplement may be delivered directly into the mouth;
- To provide a system for storage and delivery of powdered nutritional supplements wherein staleness and/or deterioration of the supplement may be reduced;
- To provide a system for storage and delivery of powdered nutritional supplements wherein the powdered supplement may be stored within and/or delivered from an elongated tube;
- To provide a system for storage and delivery of powdered nutritional supplements which minimizes retention of the supplement in the teeth and/or discoloration of the teeth and mouth;
- To provide a system for storage and delivery of powdered nutritional supplements which facilitates regular and consistent use of a supplement;
- To provide a system for storage and delivery of powdered nutritional supplements wherein convenience and/or ease of consumption of a supplement are enhanced; and
- To provide a system for storage and delivery of powdered nutritional supplements which facilitates ready transport of a limited supply of supplement.

One or more of the foregoing objects may be achieved in the present invention by an apparatus for storing and delivering a powdered nutritional supplement comprising: a) an elongated tube; and b) a volume of powdered nutritional supplement contained within the tube. The ends of the tube may be sealed to retain the powdered supplement within the tube, and at least one end may be opened to deliver the powdered supplement from the tube. One or more of the foregoing objects may be achieved in the present invention by a method for storing a powdered nutritional supplement comprising the steps of a) filling an elongated tube with the powdered supplement; and b) sealing the ends of the tube, thereby retaining the powdered supplement within the tube for storage. One or more of the foregoing objects may be achieved in the present invention by a method for delivering a powdered nutritional supplement comprising the steps of a) providing a container filled with a volume of the powdered supplement corresponding to a single dose; b) opening the container; and c) allowing the powdered supplement to leave the container for delivery directly into the mouth.

Additional objects and advantages of the present invention may become apparent upon referring to the preferred and alternative embodiments of the present invention as illustrated in the drawings and described in the following written description and/or claims.

DETAILED DESCRIPTION OF PREFERRED AND ALTERNATIVE EMBODIMENTS

Figure 1:
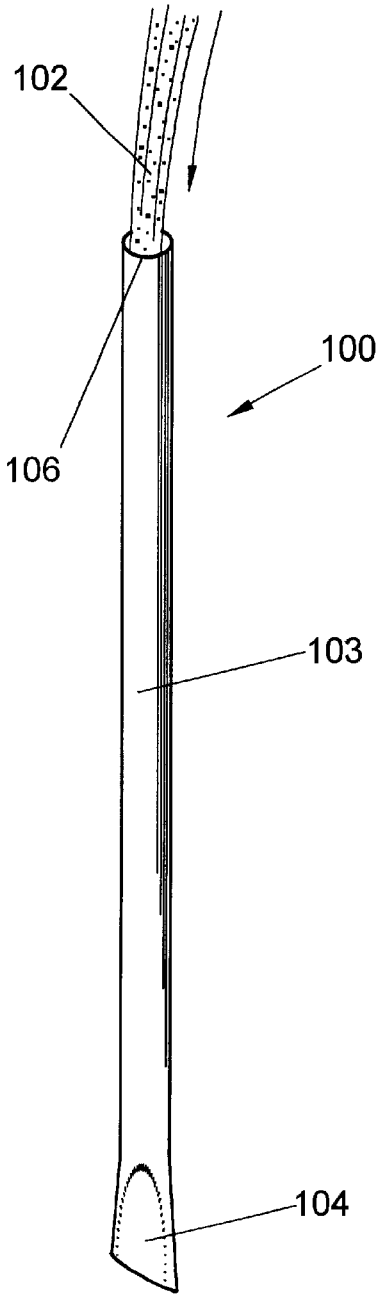
FIG. 1 shows a storage and delivery apparatus being filled with powdered nutritional supplement according to the present invention.
Figure 2:
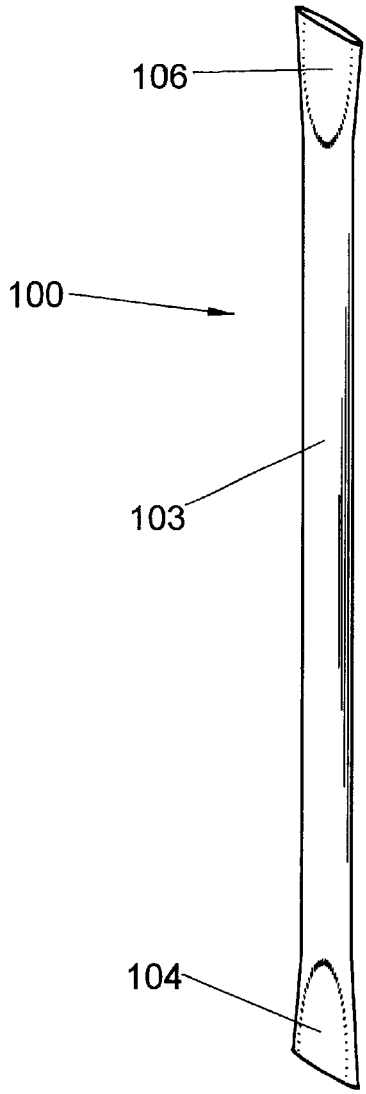
FIG. 2 shows a filled storage and delivery apparatus sealed for storage of powdered nutritional supplement according to the present invention.

FIGS. 1, 2, 3, and 4 depict storage and delivery apparatus and methods for a powdered nutritional supplement. Storage and delivery device 100 comprises an elongated tube 103 having ends 104 and 106. FIG. 1 shows powdered supplement 102 being placed within tube 103 through open end 106 (106 in this example, although either end may be used for filling). Ends 104 and 106 may be sealed as shown in FIG. 2, thereby retaining powdered supplement 102 within storage and delivery device 100 for storage. The volume of powdered supplement 102 may correspond to a single dose of the supplement.

Figure 3:
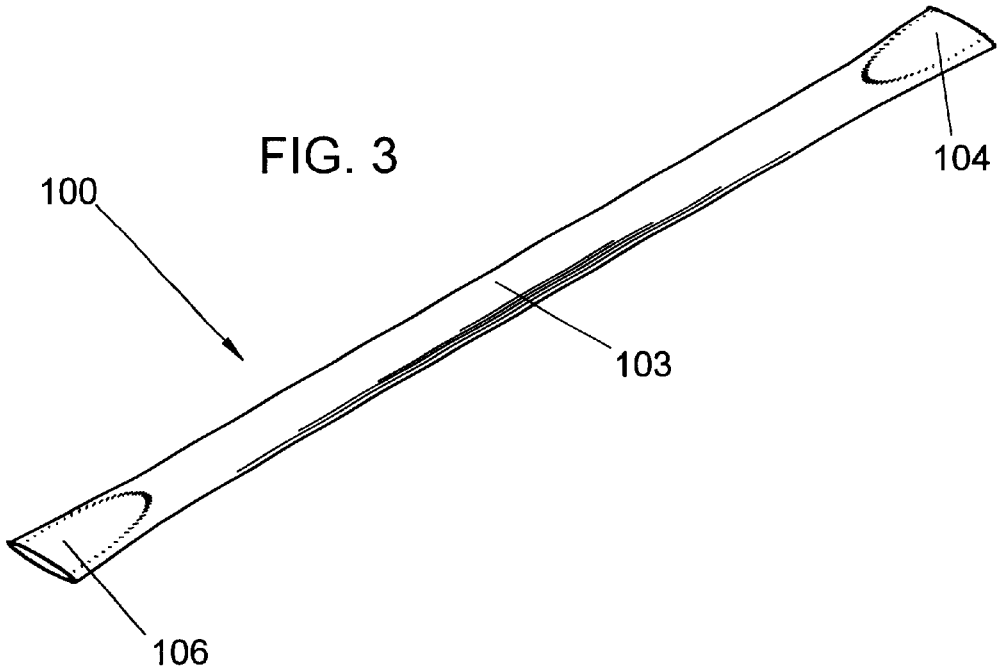
FIG. 3 shows a filled storage and delivery apparatus prior to delivery of powdered nutritional supplement according to the present invention.
Figure 4:
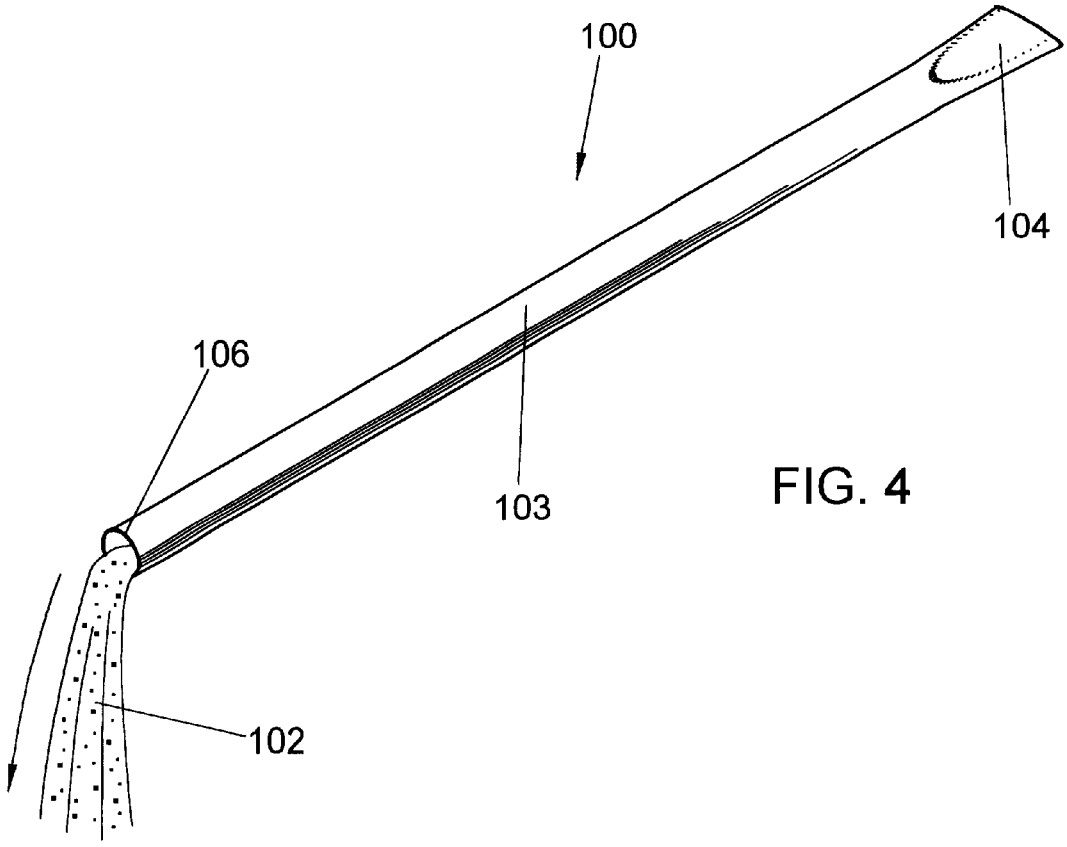
FIG. 4 shows delivery of a powdered nutritional supplement from a filled storage and delivery apparatus according to the present invention.

FIG. 3 shows the filled storage and delivery apparatus 100 in preparation for delivery of powdered supplement 102. One of sealed ends 104 and 106 may be opened (106 in this example, although either end may be opened) and the powdered supplement delivered therethrough, as shown in FIG. 4. Powdered supplement 102 may preferably be delivered directly into the mouth for consumption, or alternatively may be mixed with food or drink for consumption, if desired. Powdered supplement 102 may preferably be pleasantly flavored or at least palatable, however the use of an unflavored or unpalatable powdered supplement shall be construed to fall within the scope of inventive concepts disclosed and/or claimed herein.

The apparatus and methods according to the present invention disclosed and/or claimed herein solve many of the aforementioned problems associated with previous nutritional supplements. By solving one or more of these problems, regular and consistent use of the nutritional supplement is facilitated.

Since the supplement is in powdered form, it need not be chewed, but may be immediately swallowed or allowed to quickly dissolve in the mouth. In either case, no supplement is stuck in the teeth, and there is less uncertainty as to the dosage delivered. If taken after brushing one's teeth, additional brushing should not be required; merely rinsing the mouth should be sufficient to remove the residual flavor of the powdered supplement (if any). Dental problems, dental work, orthodontics, or the like should cause no impediment to taking the powdered supplement. Manufacturing is simplified, since molds and/or presses are not required as for swallowed-whole or chewable supplements. The powdered supplement need not be colored, thereby avoiding the problem of discolored mouth and/or teeth. Any informative, decorative, and/or child-enticing coloring or markings may be applied to the outside of tube 103, instead of in/on the supplement itself Swallowing a powdered supplement also does not present the usual difficulties associated with swallowing whole tablets.

Freshness and/or storage problems are also reduced through implementation of the present invention. Each tube may contain a single dose of powdered supplement, thereby avoiding staleness/spoilage problems associated with incompletely re-sealed multi-dose containers. Storage of a limited supply of powdered supplement is greatly simplified: any desired number of doses may be stored independently without compromising freshness, since each individual dose may have its own packaging in a separate tube.

In a preferred embodiment of the present invention, tube 103 comprises a straw (similar to a drinking straw), which may be made from paper, cardboard, or plastic (each with or without suitable coating material). Without departing from inventive concepts disclosed and/or claimed herein, any suitable material or combination of materials may be employed for tube 103, including as examples (but not limited to): paper, cardboard, plastic, rubber, metal, metallic foil, resin, edible materials, soluble materials, membranous materials, cellophane, cellulose, films, coatings, starch- or other carbohydrate-based materials, collagen or collagen-like materials, proteins or protein-based materials, lipid-based materials, fabrics, combinations thereof, and/or functional equivalents thereof Tube 103 may be colored and/or carry any desired ornamental, amusing, entertaining, informative, and/or other markings, including but not limited to product names, dosage directions, ingredient lists, pictures, illustrations, patterns, cartoon characters, jokes, riddles, inspirational/thought-provoking sayings or quotations, and so forth.

In a preferred embodiment of the present invention, ends 104 and 106 of tube 103 are sealed by crimping, and at least one of ends 104 and 106 are opened by un-crimping. Without departing from inventive concepts disclosed and/or claimed herein, any method or device may be employed to seal ends 104 and 106 and allow at least one of ends 104 and 106 to be opened, including as examples (but not limited to): crimping; un-crimping; pulling apart a crimp; folding; un-folding; sealing with adhesive; breaking an adhesive seal; cutting, tearing, or biting off an end of the tube; providing perforations for tearing; providing serrated edges to facilitate tearing; providing a zipper-type seal (similar to zipper-type plastic bags used for food storage and the like); resinous seals; waxy seals; stitching; staples, clips, clamps, and the like; hinged lid or flip-top; a plug; a cap; a screw-type seal; functional equivalents thereof, and/or combinations thereof.

Figure 5A:
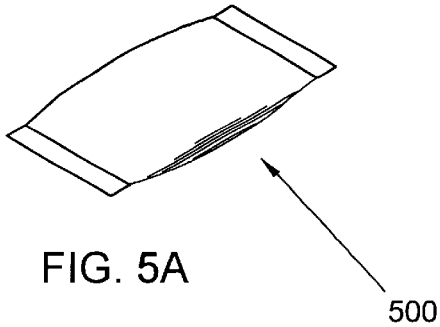
FIGS. 5A and 5B show storage and delivery of a powdered nutritional supplement from an alternative filled storage and delivery apparatus according to the present invention.
Figure 5B:
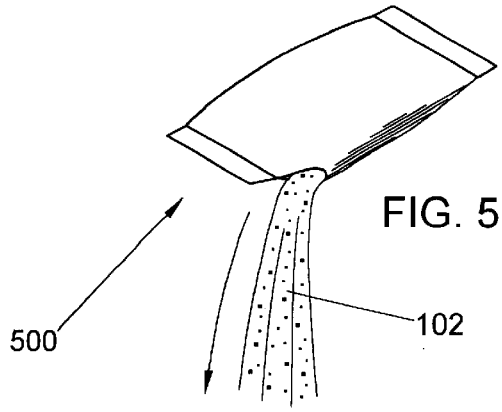
Figure 6A:
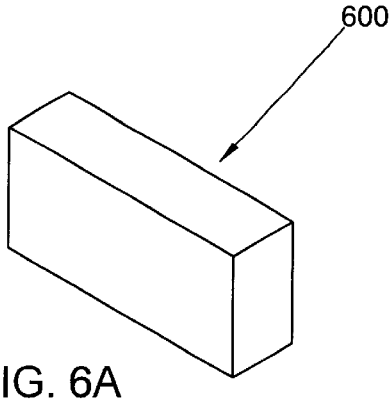
FIGS. 6A and 6B show storage and delivery of a powdered nutritional supplement from an alternative filled storage and delivery apparatus according to the present invention.
Figure 6B:
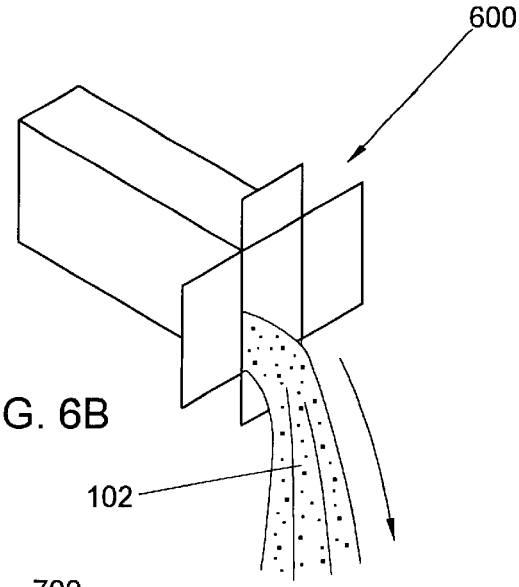
Figure 7A:
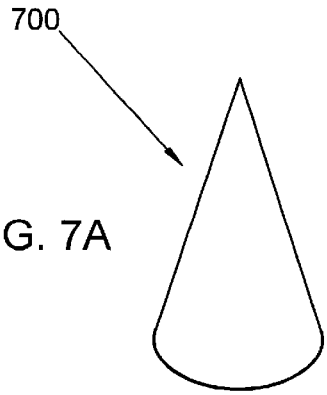
FIGS. 7A and 7B show storage and delivery of a powdered nutritional supplement from an alternative filled storage and delivery apparatus according to the present invention.
Figure 7B:
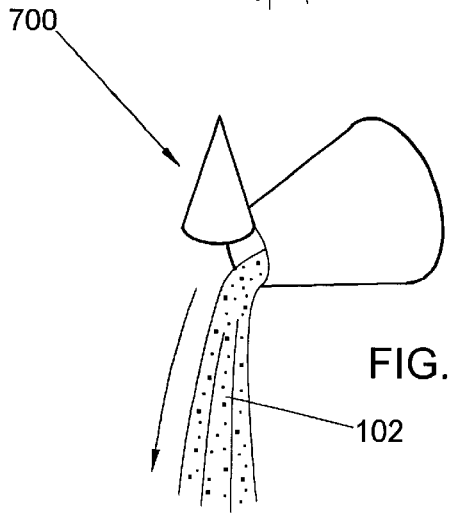

Without departing from inventive concepts disclosed and/or claimed herein, any container configuration may be employed that is suitable for storing and/or delivering a powdered nutritional supplement as disclosed herein. Such container configurations may preferably contain a single dose of the nutritional supplement, and may preferably be used to deliver the nutritional supplement directly into the mouth. Such configurations may include as examples (but are not limited to): an elongated tube sealed at the ends as described hereinabove; a flexible pouch; a tube with one or more enlarged and/or bulbous segments; substantially rigid containers of various three-dimensional shapes or segments thereof (cube, rectangular prism, sphere, oval or ovoid, ellipsoid, cylinder, cone, frustum, tetrahedron, polyhedron, pyramid, and so forth); toy, jewelry, and/or novelty items configured to contain the powdered supplement; functional equivalents thereof; and/or combinations thereof FIGS. 5A and 5B show storage and delivery device 500 in the form of a flexible pouch containing and delivering powdered supplement 102. FIGS. 6A and 6B show storage and delivery device 600 in the form of a rectangular box containing and delivering powdered supplement 102. FIGS. 7A and 7B show storage and delivery device 700 in the form of a cone containing and delivering powdered supplement 102. Such alternative container configurations may employ any suitable materials, including but not limited to the examples given hereinabove for the tube embodiment of the present invention. Such alternative container configurations may employ any suitable closure/sealing/opening mechanism, including but not limited to the examples given hereinabove for the tube embodiment of the present invention. Such alternative container configurations may be colored and/or carry any desired ornamental, amusing, entertaining, informative, and/or other markings, including but not limited to product names, dosage directions, ingredient lists, pictures, illustrations, patterns, cartoon characters, jokes, riddles, inspirational/thought-provoking sayings or quotations, and so forth.

The present invention has been set forth in the forms of its preferred and alternative embodiments. It is nevertheless intended that modifications to the disclosed system for storage and delivery of powdered nutritional supplements may be made without departing from inventive concepts disclosed and/or claimed herein.

What is claimed is:

1. A method for delivering a powdered nutritional supplement directly into a mouth of a user, comprising the steps of:

a) providing a container containing a volume of the powdered supplement corresponding to a single dose of the supplement;

b) opening the container; and c) delivering the powdered supplement from the container directly into the mouth.

2. A method for delivering a powdered nutritional supplement as recited in claim 1, wherein:

the container comprises an elongated tube having a first end and a second end;

the volume of the powdered supplement is contained within the tube; and at least one of the first end and the second end of the tube may be opened for delivering the powdered supplement therefrom.

3. A method for delivering a powdered nutritional supplement as recited in claim 2, wherein the tube comprises a straw.

4. A method for delivering a powdered nutritional supplement as recited in claim 3, wherein the first end and the second end may be sealed by crimping the straw.

5. A method for delivering a powdered nutritional supplement as recited in claim 2, wherein the first end and the second end may be sealed by crimping the tube.

6. A method for storing and delivering a powdered nutritional supplement, comprising the steps of:

a) filling a container with a volume of the powdered supplement corresponding to a single dose of the supplement;

b) sealing the container, thereby retaining the powdered supplement within the container for storage;

c) opening the container; and d) delivering the powdered supplement from the container directly into the mouth.

7. A method for storing and delivering a powdered nutritional supplement as recited in claim 6, wherein:

the container comprises an elongated tube having a first end and a second end;

the volume of the powdered supplement is contained within the tube; and at least one of the first end and the second end of the tube may be opened for delivering the powdered supplement therefrom.

8. A method for storing and delivering a powdered nutritional supplement as recited in claim 7, wherein the tube comprises a straw.

9. A method for storing and delivering a powdered nutritional supplement as recited in claim 8, wherein the first end and the second end may be sealed by crimping the straw.

10. A method for storing and delivering a powdered nutritional supplement as recited in claim 7, wherein the first end and the second end may be sealed by crimping the tube.

* * * * *